United States Patent [19]

Abendroth

[11] 4,238,293

[45] Dec. 9, 1980

[54] MAINTENANCE AND REPAIR STATION FOR CHARGING CARS OF COKE OVEN BATTERIES

[75] Inventor: Werner Abendroth, Haltern, Fed. Rep. of Germany

[73] Assignee: Firma Carl Still, Fed. Rep. of Germany

[21] Appl. No.: 43,702

[22] Filed: May 30, 1979

[30] Foreign Application Priority Data

Jun. 3, 1978 [DE] Fed. Rep. of Germany ..... 2824516

[51] Int. Cl.[3] ..... C10B 45/00; B60S 13/00; B61J 3/10; E01B 25/06

[52] U.S. Cl. ..... 202/270; 104/131

[58] Field of Search ..... 202/239, 262, 270; 104/48, 88, 131; 187/16

[56] References Cited

U.S. PATENT DOCUMENTS

| | | | |
|---|---|---|---|
| 707,525 | 8/1902 | Seaver | 202/262 X |
| 2,922,381 | 1/1960 | Hormi | 104/48 |
| 3,065,714 | 11/1962 | Orwin | 104/88 |
| 3,315,825 | 4/1967 | Scheinert | 103/131 X |
| 3,556,011 | 1/1971 | Saxonmeyer | 104/48 |
| 3,774,784 | 11/1973 | Glass | 104/131 X |

*Primary Examiner*—Joseph Scovronek
*Attorney, Agent, or Firm*—McGlew and Tuttle

[57] ABSTRACT

A maintenance and repair station for the maintenance and repair of charging cars of coke oven batteries comprises an elevator which has a cage with a trackway which forms a portion of the roof trackway over which the charging car operates and which may be shifted to a different elevation, for example, downwardly to position another trackway portion identical in length with the first in a position in which it forms a portion of the trackway over the coke oven battery. In this matter a charging car may be loaded onto the elevator and lowered to a repair station or raised to a different repair station while another track may be orientated in a place taken by the trackway portion of the elevator which also forms a portion of the trackway over the coke oven roof. Once the car has been removed, for example, downwardly into another station it may be maintained or repaired at such station while the trackway at the other level of the elevator is aligned with the charging car trackway on the roof so that other cars may be passed over the roof without interference.

5 Claims, 2 Drawing Figures

MAINTENANCE AND REPAIR STATION FOR CHARGING CARS OF COKE OVEN BATTERIES

BACKGROUND OF THE INVENTION

1. Field of the Invention

This invention relates in general to the construction of coke ovens and in particular to a new and useful charging car arrangement wherein the charging car runs over a trackway on the roof of the coke oven battery and an elevator is provided for shifting the car to a distinct level while simultaneously providing another length of trackway identical with the length of trackway over which the car is first driven so as to provide a non-interrupted passage for charging cars while another charging car is maintained or repaired at a separate repair station at a different elevation from the charging car trackway.

2. Description of the Prior Art

Even though such charging cars are very rugged in construction, they are exposed to very rough service conditions so that, from time to time, they must be removed from the battery roof and transferred to a repair station, for maintenance or overhaul. In practice, repair stations are found on the end platforms of batteries, beyond the battery heads. As soon as the charging car requiring repair is removed from the area of oven chambers to be charged, a second charging car in service on the battery roof may serve the oven chambers without being hindered in any way by the car to be repaired. Such a repair station may be provided at the battery end for two charging cars of any battery.

However, if more than two charging cars are in service on the battery, which is frequently the case with large plants, difficulties arise with the maintenance or repair of cars servicing the central working area. Anyway, at least one of the cars remaining in service is then blocked and it may happen that the entire work must be done by a single charging car.

SUMMARY OF THE INVENTION

The invention is directed to a maintenance and repair station to which any of the charging cars can be transferred without running the risk of blocking the operation of other cars.

In accordance with the invention, coke oven battery includes a charging car trackway on its roof and a portion of this trackway is made up of rail sections defined on an elevator or lift at two distinct locations. When one of the locations is already in the charging car trackway to complete the trackway a car may be driven onto it and may be shifted into a different level. At the different level the car may be operated on and repaired. In addition the other trackway aligns with the charging car trackway in the same manner as the first trackway portion so that other charging cars may be still moved over the trackway on the roof.

It is advantageous to provide such a height of the elevator cage that in its lowered position, the cage floor is flush with the floor of the battery (for example, the deck of the gangway). No intermediate platform is then needed.

The novel repair station may be provided at the end of coke oven batteries. It is more convenient, however, to provide it between two batteries, since then even the maintenance and repair of charging cars operating in the central area may be affected without providing auxiliary tracks at the battery floor level and without substantial switching.

In any case, the construction of the elevator cage is to be sufficiently stable to allow the entire operation of charging cars of the battery over its top, without suffering damage.

Accordingly, it is an object of the invention to provide a coke oven battery which has a charging car trackway on its roof with a roof section which includes an elevator having trackway portions at two distinct levels which form part of the charging car trackway when they are disposed at the same level and which includes life means which is capable of shifting the trackways with the charging car thereon into a distinct level at which the car may be maintained or repaired while the other trackway portion is aligned with the charging car trackway so that other cars may be passed over this trackway.

A further object of the invention is to provide a coke oven battery charging car repair and maintenance station which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
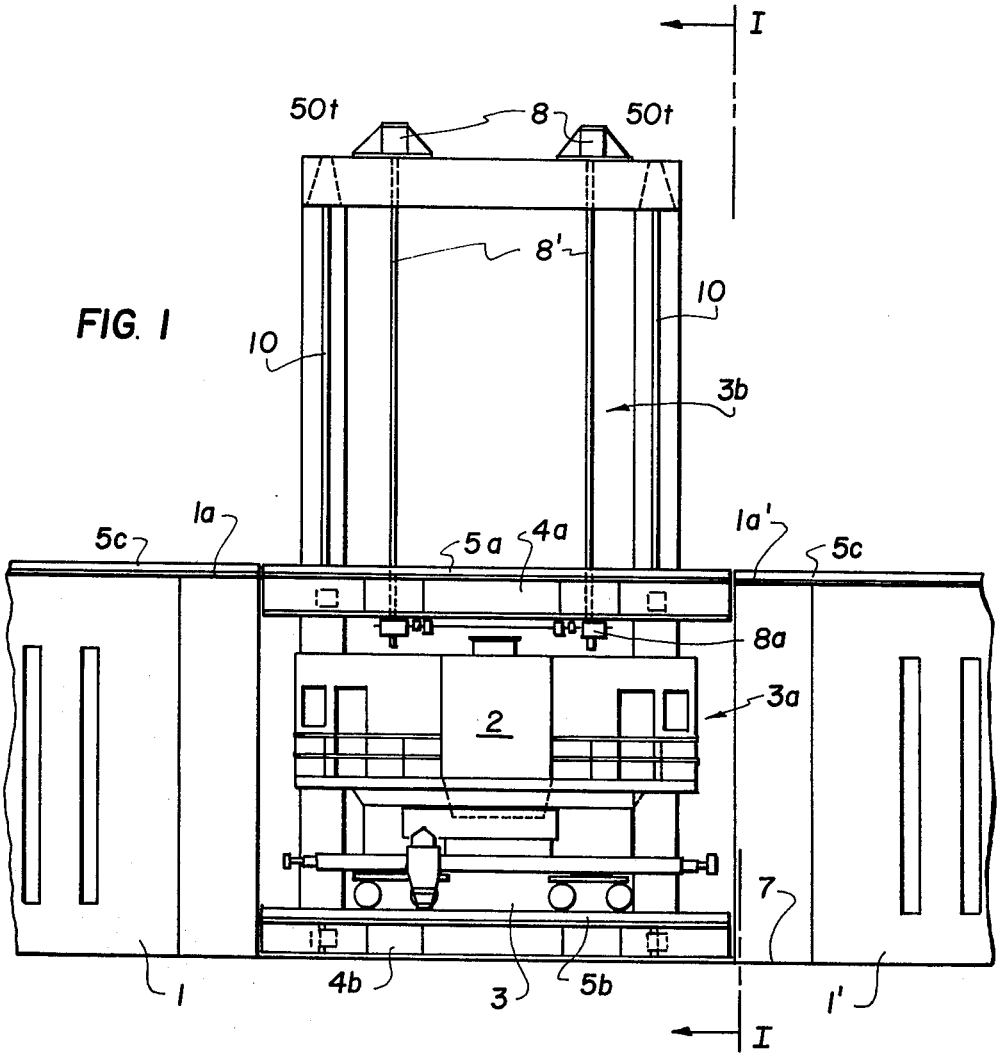
FIG. 1 is a side elevational view of a coke oven battery having a repair station for charging cars constructed in accordance with the invention which is advantageously located between two coke oven batteries.
Figure 2:
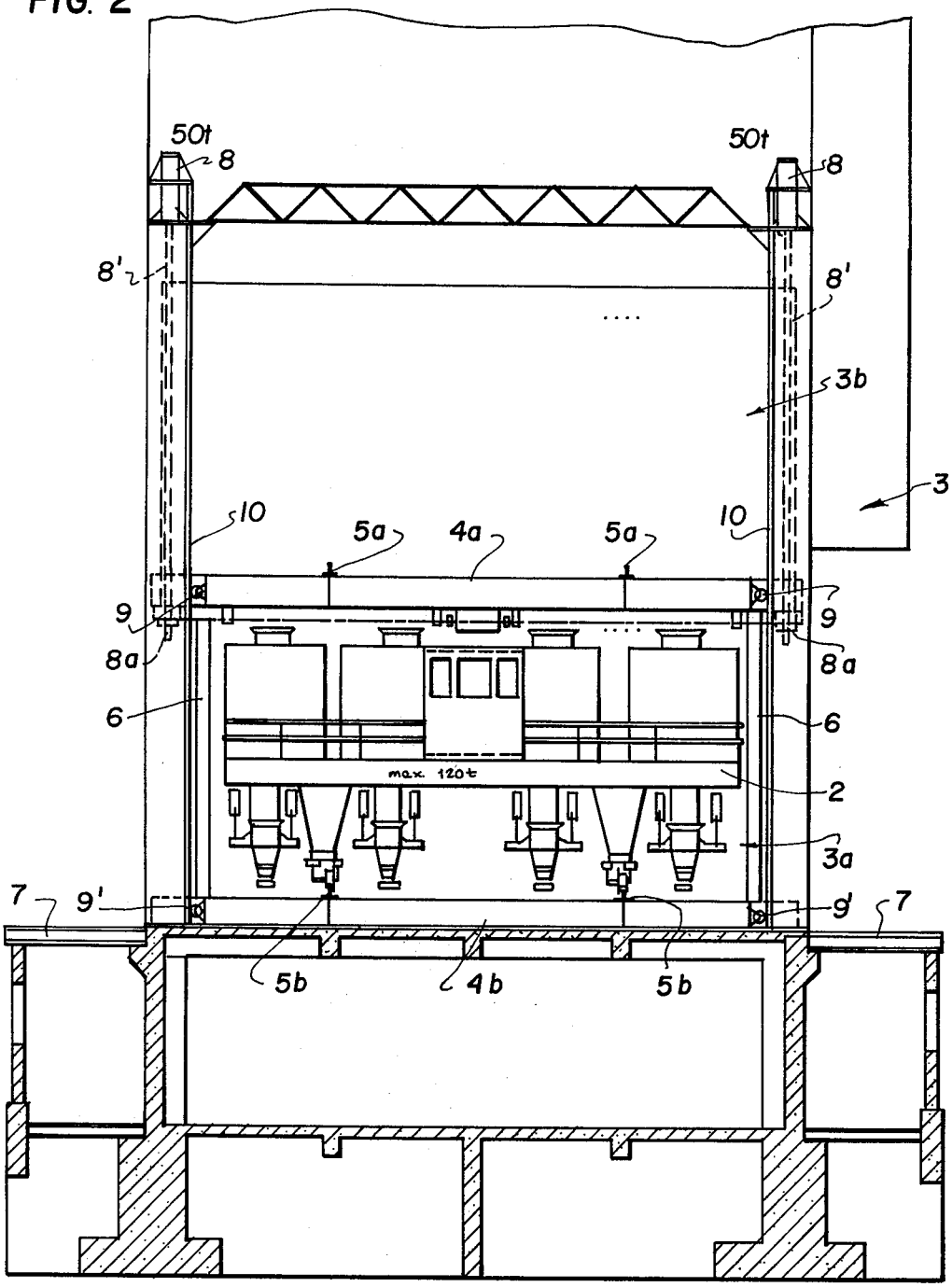
FIG. 2 is a sectional view taken along the line 1—1 of FIG. 1.

Referring to the drawings in particular, the invention embodied therein, comprises, an elevator device for providing a repair station for a charging car 2, which is adapted to run over a roof l*a* of a coke oven battery or series of batteries 1, 1' etc. In the embodiment shown in the drawings a elevator cage device generally designated 3 is located between two adjacent batteries 1 and 1' and it provides means for shifting the track section 5*a* or 5*b* from the level of a charging car trackway 5*c* defined on the roof 1*a* of the coke oven batteries.

In both figures, the charging car 2 is shown as received in an elevator cage 3 which is lowered to the level of the gangway deck 7 into a repair station 3*a*, and the elevator 3 comprises a top or ceiling 4*a* and a bottom or floor 4*b* having charging car track rails 5*a*, 5*b* mounted thereon, and side walls 6. The two front sides of the cars, as viewed in the traveling direction are open.

During maintenance work at the repair station 3*a* on one of the charging cars 2, the entire oven charging operation on the battery roof is insured by other cars. The rugged top 4*a* of the elevator cage 3 with the track rails 5*a* allow an unhindered travel of the charging cars along the entire range of the battery over the roof 1*a*.

As the maintenance or repair of the charging car 2 is terminated, the entire elevator 3 with the charging car 2 received therein is elevated forwardly from repair station 3*a* to receiving station 3*b* by lift means 8. The lift means or drive mechanism 8 for this purpose comprises a drive motor 8 which rotates spindle-type elevating elements 8' which engage nuts 8*a* on the elevator 3. This construction insures synchronism and automatic locking of the total load. Hydraulic cylinders or hoisting mechanisms (not shown) may also be connected for synchronous operation, or crane installations (not shown) may also be used.

The entire elevator cage is guided on its sides, along the total lifting range, by means of roller sets 9 and 9' which are guided on upright rails 10. As soon as the total height of lift of the elevator, that is the battery roof level is reached, so that floor rails 5*b* become aligned with the track rails 5*c* located on a battery roof 1*a* of the coke oven 1, the charging car 2 is transferred from the repair station 3*a* either above or below (embodiment shown) the roof 1*a* to the receiving station 3*b* at the roof of the battery. Then, if needed, the next charging car 2 may be transferred into the elevated (now empty) elevator 3 or the empty elevator 3 may be lowered again into its initial position. Consequently, anytime any charging car 2 can be removed from the battery roof receiving station 3*b* and received in the empty, elevator it may be shifted to the repair station 3*b*, and mechanical parts may be exchanged or repaired without much preparation and without interference with the passage of another car 2 over the track 5*c* (and either 5*a* or 5*b*) on the roof 1*a*.

While specific embodiments of the invention have been shown and described in detail to illustrate the application of the principles of the invention, it will be understood that the invention may be embodied otherwise without departing from such principles.

What is claimed is:

1. In a coke oven battery including a charge car trackway defined on the roof thereof for the passage of a charging car, the improvement comprising a charging car receiving lift having at least two trackway portions thereon located at separate vertically spaced levels each forming a portion of the charge car trackway when they are respectively disposed at the level of the charging car trackway on a line therewith, means defining a repair station at a level distinct from the level of said charging car trackway, and lift means for selectively shifting said lift to dispose a respective receiving trackway portion in alignment with the charging car trackway and a respective receiving track portion at a vertically spaced level from said charging car trackway in said repair station defining means, a charging car being receivable on a trackway portion and being transferable by said lift means to a different level from said charging car trackway for the maintenance or repair of the car at such level while the other of said trackway portion is located in alignment with and forms a part of the charging car trackway with the passage of other charging cars thereon.

2. In a coke oven battery according to claim 1 wherein said means defining a repair station defines a repair station below said charging car trackway with lift means transferring trackway portion with a charging car thereon downwardly into repair station defining means.

3. In a coke oven battery according to claim 1 wherein said receiving lift comprises an elevator cage having a floor with a trackway portion thereon and a roof thereabove having a trackway portion defined thereover said cage being located so that the floor trackway is located in alignment with the charging car trackway for receiving a car and is positioned downwardly below said trackway in said repair station defining means while a roof trackway is then aligned with said charging car trackway.

4. A coke oven battery comprising at least one coke oven having a charging car trackway defined thereon, an elevator cage disposed along said trackway and having a floor with a first track portion alignable with and forming a part of said charging car trackway and a roof with a second trackway portion vertically spaced above said floor trackway, said elevator cage adapted to receive a charging car therein on said floor trackway and to be shifted downwardly to position the car in a location below said charging car trackway for repair and maintenance thereof and to position the roof trackway in alignment with said charging car trackway so that the charging car trackway is uninterrupted for the passage of cars thereover.

5. A coke oven battery according to claim 3 wherein said at least one coke oven battery comprises at least two coke ovens with said elevator being disposed therebetween.

* * * * *